US010272495B2

(12) United States Patent
Clark

(10) Patent No.: US 10,272,495 B2
(45) Date of Patent: Apr. 30, 2019

(54) HIP CAN MANUFACTURE PROCESS

(71) Applicant: MAHER LTD, South Yorkshire (GB)

(72) Inventor: Gerry Clark, Lincolnshire (GB)

(73) Assignee: Liopleurodon Capital Limited, London (GB)

( * ) Notice: Subject to any disclaimer, the term of this patent is extended or adjusted under 35 U.S.C. 154(b) by 505 days.

(21) Appl. No.: 14/898,337

(22) PCT Filed: Jul. 21, 2014

(86) PCT No.: PCT/GB2014/052221

§ 371 (c)(1),
(2) Date: Dec. 14, 2015

(87) PCT Pub. No.: WO2015/022487

PCT Pub. Date: Feb. 19, 2015

(65) Prior Publication Data

US 2016/0144432 A1 May 26, 2016

(30) Foreign Application Priority Data

Aug. 13, 2013 (GB) ..... 1314444.9
Aug. 21, 2013 (GB) ..... 1314978.6

(51) Int. Cl.

| | |
|---|---|
| ***B22F 3/00*** | (2006.01) |
| ***B22F 3/12*** | (2006.01) |
| ***B22F 3/15*** | (2006.01) |
| ***B22C 9/04*** | (2006.01) |

(52) U.S. Cl.

CPC ..... *B22F 3/1275* (2013.01); *B22C 9/04* (2013.01); *B22C 9/046* (2013.01); *B22F 3/1216* (2013.01); *B22F 3/15* (2013.01); *B22F 3/156* (2013.01); *B22F 2003/153* (2013.01); *B22F 2998/10* (2013.01)

(58) Field of Classification Search

CPC ..... B22F 3/1275; B22F 3/15; B22F 3/156; B22F 3/1216; B22C 9/04; B22C 9/046
USPC ..... 419/8, 49
See application file for complete search history.

(56) References Cited

U.S. PATENT DOCUMENTS

| | | | |
|---|---|---|---|
| 3,841,870 | A | 10/1974 | Hamijian |
| 4,065,303 | A | 12/1977 | Seilstorfer et al. |
| 4,861,546 | A | 8/1989 | Friedman et al. |
| 4,904,538 | A | 2/1990 | Juhas |
| 4,927,600 | A | 5/1990 | Miyashita et al. |
| 5,000,911 | A | 3/1991 | Ekbom et al. |
| 5,415,832 | A | 5/1995 | Friborg et al. |
| 5,507,336 | A | 4/1996 | Tobin |

(Continued)

FOREIGN PATENT DOCUMENTS

| | | |
|---|---|---|
| EP | 2591867 | 5/2013 |
| GB | 1566858 A | 5/1980 |
| JP | H0368705 A | 3/1991 |

OTHER PUBLICATIONS

European Examination Report, dated Jul. 19, 2018, in connection with European Application No. 14742344.6.

(Continued)

*Primary Examiner* — Mark A Chapman
(74) *Attorney, Agent, or Firm* — Meunier Carlin & Curfman LLC

(57) ABSTRACT

An improved method of forming components by hot isostatic pressing (HIP) involves making a can for the HIP process from a ceramic mold, reducing the need for welding & machining in the production of the can.

20 Claims, 5 Drawing Sheets

(56) References Cited

U.S. PATENT DOCUMENTS

| | | | |
|---|---|---|---|
| 5,770,136 | A | 6/1998 | Huang |
| 6,042,780 | A | 3/2000 | Huang |
| 6,355,211 | B1 | 3/2002 | Huang et al. |

OTHER PUBLICATIONS

International Search Report and Written Opinion, dated Oct. 31, 2014 from the European Searching Authority.

HIP CAN MANUFACTURE PROCESS

This invention relates to a method for producing cans for use in a hot isostatic pressing (HIP) manufacturing process, and a can produced thereby.

BACKGROUND

Metal products may be made in several ways. One way is to machine a block of cast, wrought or forged metal to a required shape. However, this frequently results in waste. A novel, but known way of constructing components is to provide metal in a fine powder form and shape it in a "can" that approximates to the desired end shape. The can is typically made of mild steel so that it is deformable, although other materials can be used. The can is filled with the powder which is then settled in the can as much as possible by vibration. Ultimately, the can is evacuated and sealed. The can is then placed in a chamber which is pressurised and heated so that the can shrinks and pressurises the powder. The grains of the powder stick together, by a process known as diffusion bonding, to form a solid block having the approximate shape of the desired end product. The composite can/block is then usually machined to remove the can, which is at this point a skin on the product, and also to remove a surface layer of the powder block to achieve desired dimensions and finish.

A known can is mild steel between 2 and 3 mm thick. Cans are normally degassed at intermediate temperatures (ca. 300° C.), sealed, preheated and then exposed to HIP in a pressure vessel. In the case of powder metallurgy (PM) superalloys, typical HIP conditions are a temperature of between 1100° C. and 1260° C., and a pressure of between 100 MPa and 200 MPa, which is maintained for several hours with argon as the pressurising medium. The superalloy powders are consolidated to full density during the HIP process by pressure assisted sintering. The can is removed by rough machining and/or pickling to reveal the near net-shape component. Compound products can also be produced by designing cans with separate compartments for different powders or enclosing parts of solid material together with the powder.

A known method of fabrication of the can is by welding together strips of mild steel to form the hollow "mould" in which the powder is contained before the HIP process is started. Fabrication in this way introduces dimensional errors through inconsistency in the process. Also, it is a time consuming process, especially if multiple components are to be made, and is not reliably repeatable. Furthermore, weld seams cannot be controlled, at least internally of the can. Accordingly, sufficient tolerance in the dimension of the finished part must be provided so that indents in the finished product, caused by unintended upstands on the internal surface of the can (at the seams) can be machined out after the HIP process has been completed and the can machined away.

As well as the production of cans for HIP manufacture by welding plates together, U.S. Pat. Nos. 4,065,303, 4,861,546 and 5,000,911 disclose production by electroplating, or otherwise coating, a blank component with a metal. The blank is then removed to leave behind the coating which forms the can.

U.S. Pat. Nos. 5,770,136, 6,355,211 and 6,042,780 also construct a mould. The mould is formed by moulding powder and binder around a blank, and ultimately filling the mould with powder. The moulded powder mould is inserted in a can (that is welded) for HIP. The can has no part in shaping the final product.

U.S. Pat. No. 5,000,911 appears to disclose:

- fabricating a steel blank of the component to be formed;
- creating around the blank a mould from rubber or a material that can be cut;
- moulding in the mould a settable blank from wax or the like, and peeling off the rubber mould;
- coating the wax blank with graphite powder and cement of the same type;
- melting the wax;
- filling the graphite mould with metal powder and performing HIP, the "can" so-produced being supported in powder during the HIP process.

It is an objective of the present invention to mitigate at least some of the problems described above and provide a reproducible and effective method of metal component production using powder metallurgy technology.

BRIEF SUMMARY OF THE DISCLOSURE

The present invention provides a method of forming a component from metal powder, comprising the steps of:

a. providing a ceramic mould using a lost wax process
b. casting liquid metal in the ceramic mould to form a can;
c. forming a hole in the can;
d. filling the can through the hole with the metal powder;
e. settling the metal powder in the can, evacuating the can of gas and sealing the can; and
f. subjecting the can and contained powder to a hot isostatic pressing environment to bond the metal powder into a solid component.

It is to be understood that the term "lost wax process" is used to cover a process of mould preparation where a solid form is coated with ceramic and the form is subsequently removed by melting (for example in the case of wax), burning, heating or dissolving. For example, a high density polystyrene foam can be used which is combusted and vapourised when heated. However, as used herein, the term "lost wax process" (unless the context dictates otherwise) is employed to cover similar processes that may not involve wax, as such, at all.

A component finishing step may be implemented that comprises machining the can from the formed component and completing any final dimensional corrections.

The ceramic mould may be made by:

a. forming a ceramic blank of the component from a first ceramic material;
b. coating the blank with a sacrificial layer of a thickness equal to the desired thickness of the can to be formed;
c. providing the sacrificial layer with a sacrificial stem;
d. coating the blank and sacrificial layer with a ceramic layer of a second ceramic material, leaving the sacrificial stem protruding through the ceramic layer;
e. curing the ceramic layer; and
f. treating the mould to remove the sacrificial layer and stem.

The sacrificial components of the mould (that is, the sacrificial layer and the sacrificial stem) may be wax or wax-like material, or a material such as polystyrene, and the treating step may be effected by heat that melts and/or vapourises the sacrificial components.

The step of casting the liquid metal in the ceramic mould may simultaneously remove the sacrificial layer and/or stem.

In this way, a can may be fabricated without any requirement for welding.

In a preferred embodiment several holes are formed in the can.

In an alternative embodiment only one hole is formed in the can.

In a preferred embodiment the hole or holes in the can are formed during casting by providing hole forming pips on the core. Said hole forming pips then support the ceramic core within the shell after the wax has been removed.

In an alternative embodiment, the ceramic mould may be made by:

a. forming a blank of the component from a first material, the blank including a stem extending from the shape of the component to be formed;
b. providing a shell mould in at least two parts;
c. mounting the blank in the mould by clamping the stem between the mould parts
d. moulding a sacrificial layer in the mould of a shape equal to the shape of the can to be formed;
e. coating the sacrificial layer with a ceramic layer of a ceramic material, leaving the stem protruding through the ceramic layer; and
f. curing the ceramic layer.

A final step may comprise:

g. treating the ceramic mould formed by said curing of the ceramic layer to remove the sacrificial layer and stem.

Alternatively, the blank may be formed as a solid ceramic component capable of comprising part of ceramic mould in which the can is cast.

The shell mould may be machined from an aluminium or like material block.

Where the component to be formed comprises a tubular shape, the step of providing a shell mould in at least two parts may be supplemented by providing a mould core and disposing the mould core inside the blank before the core and blank together are mounted in the mould, the core also being clamped between the mould parts. The core may also be aluminium or like material.

The stem may comprise a cylindrical surface which, when clamped between the mould parts suspends the blank within the mould parts to define at least a cup shaped space between the blank and the mould, of a shape corresponding with the shape of the can to be formed.

Where the component to be formed comprises a tubular shape, the stem may be annular and be a close sliding fit on said mould core, whereby the space defined around the blank between the core and mould parts is essentially two parallel U-shapes in section, that is a cup with the base involuted to form essentially parallel inside surfaces of the cup sides.

In a further preferred embodiment a conduit is welded to the can around the hole or holes to facilitate filling of the can with powder and subsequent gas evacuation of the can. In this embodiment the weld is preferably not one that penetrates to the interior of the can. Since the weld is not between surfaces of the can that contact the powder during the hot isostatic pressing process, there is no absolute necessity that there should be such penetration. If the weld does penetrate the interior of the can, however, then the hole is preferably formed in the can on an enlargement of can, which enlargement is provided to produce a flange on the component to be formed, which flange accommodates any upstands of the weld and is machined from the component in the component finishing step.

Using this new process can allow for variable wall thicknesses to be made in the can in conjunction with the component. For example during the HIP process, where the component is subject to great force, the component could nevertheless have thin wall thicknesses and the extra support required to prevent deformation of that particular area of the component may be provided in the design and shape of the can.

The invention also provides a can for use in a hot isostatic pressing process for the formation of a metal component from powder of the metal, wherein the can is made by:

a. providing a ceramic mould using a lost wax process;
b. casting liquid metal in the ceramic mould to form the can;

whereby the can has either:

no weld seams between surfaces of the can that contact the powder during said hot isostatic pressing process, or weld seams only around a single lid of the can, which lid closes a hole left by the moulding process forming the can, and wherein:

the can has a wall thickness of between 1 and 5 mm, preferably between 2 and 3 mm.

One or more conduits may be welded to the can about holes in the can, said holes having been formed by pips bridging a core and a shell of the ceramic mould in which the can was cast. Likewise, plates may be welded to the can about holes in the can, said holes having been formed by pips bridging a core and a shell of the ceramic mould in which the can was cast.

BRIEF SUMMARY OF THE DRAWINGS

Embodiments of the invention are further described hereinafter with reference to the accompanying drawings, in which.

DETAILED DESCRIPTION

Figure 4:
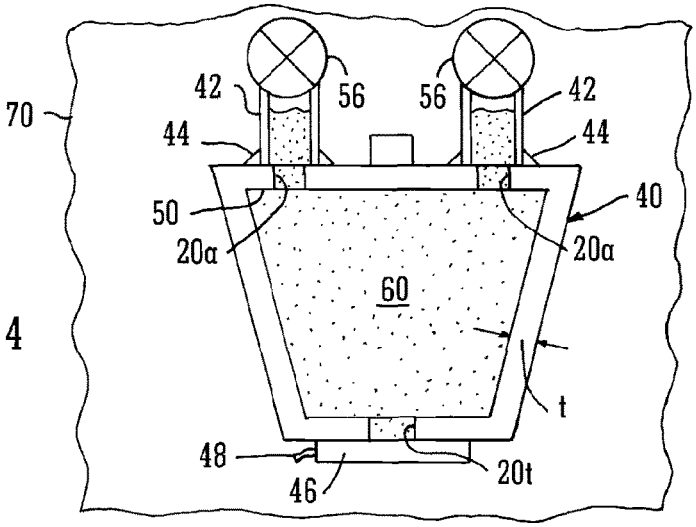
FIG. 4 is a schematic section through a formed can in a hot isostatic pressing rig.

In accordance with the present invention, a can 40 (see FIG. 4) of mild steel is formed in which metal powder 60 is packed for subsequent hot isostatic pressing to make a metal component having the basic shape of the can 40.

Figure 3:
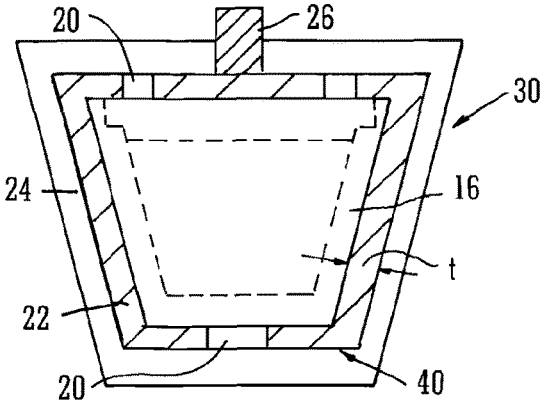
FIG. 3 is a schematic section through the formed ceramic mould.

The first stage of the process is to manufacture the can 40 and this is accomplished by fabrication of a ceramic mould 30, shown in FIG. 3, comprising a core 16 and a shell 24. In FIG. 3, a layer 22 of wax is displaced on heating and replaced by molten steel which, when cooled forms the can 40, as described further below.

Figure 1:
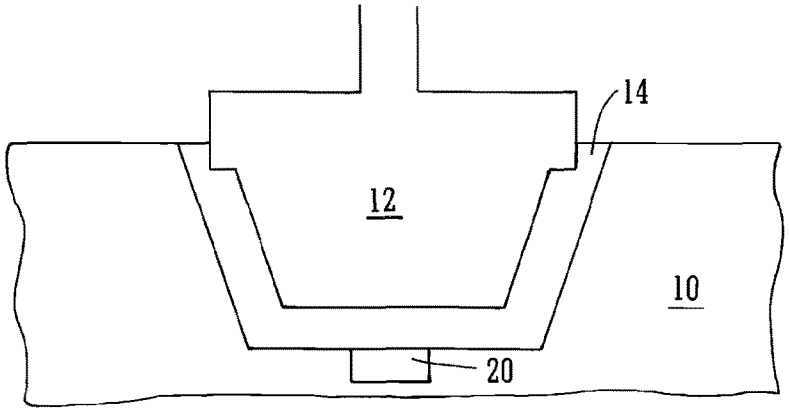
FIG. 1 is a schematic illustration of the forming of a cup part of a hollow ceramic core for use in a process according to the invention.
Figure 2:
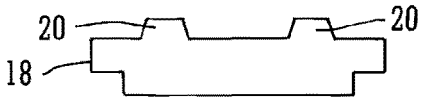
FIG. 2 is a section through a lid part of the core.

First, however, as shown in FIG. 1, a first mould 10 has a core 12 and between which a ceramic cup part 14 of the ceramic core 16 is moulded. A lid part 18, shown in FIG. 2, is moulded separately. It mates with the cup part 14 to form the hollow ceramic core 16, shown assembled in FIG. 3 in dotted lines.

When assembled, the core 16 has approximately the correct shape of the final metal component to be made, subject to the shrinking that occurs of a metal powder during hot isostatic pressing. The oversize required of the core 16 is precalculated in order to achieve the desired final dimensions of the metal part when finally formed.

Hole-forming pips 20 may be formed on the core 16. Once the core 16 is assembled, it is coated with a layer 22 of wax. The layer 22 is as thick (dimension t) as it is desired to render the wall thickness of the final can 40 to be formed. Dimension t may be 2 or 3 mm or more. Indeed, it may be greater in some areas where the metal component to be formed may need more support during the HIP process. In this event, pips 20 are as high as the desired thickness t so that their surface protrudes marginally through the wax layer. Instead of wax, other materials may be employed, such as polystyrene. When the wax coating is complete, the wax is covered with ceramic slurry 24 to make the outer shell 24. A stem 26 is provided on the wax coating so that a hole 28 is formed in the ceramic outer shell 24 when the ceramic material cures and solidifies, either by drying or any other hardening process.

When the ceramic shell is cured, the mould 30 is complete. It is then heated so that the wax 22,26 melts and can be poured from the mould 30 through the hole 26. When this is done, the hole-forming pips 20 support the ceramic core 16 within the shell 24.

Molten metal, for example, mild steel, is then poured into the mould 30 through the hole 26 and takes the same shape as the wax 22 had before it was removed. When cooled, the shell 24 is broken to expose the outside of a can 40. The ceramic core 16 may be removed in a number of different ways, one of which is to insert a probe through one of the holes 20 that shocks and shatters the core 16 so that it can be extracted through the holes 20. Alternatively, a solvent of the ceramic may be employed to dissolve the core 16. Either way, a can 40 shown in FIG. 4 results.

Conduits 42 may be welded around some of the holes 20*a*, around weld lines 44, while other holes 20*b* may be blanked off with plates 46 welded around lines 48. It is to be noted that there is no reason why the welds 44, 48 should affect the inside surface 50 of the can 40, but even if they did, the lines are so localised that the inner surface 50 could be bulged outwardly where the weld lines might protrude so that they can be machined off the final product without great difficulty.

The conduits 42 may be terminated by valves 56. The can 40 is filled with metal powder, possibly a superalloy or other desirable metal and vibrated so that the powder settles. When settling is completed, the entire can and powder contained therein is inserted in a vacuum chamber 70 to evacuate the spaces between the powder grains. When completely evacuated (to the required degree), the valves 56 are closed and the can is inserted in a HIP chamber 70 (which may be the same as or different to the vacuum chamber). The can is then heated and the chamber pressurised so that the can is compressed isostatically, squeezing the powder grains together until they sinter and fuse, forming a solid component.

When HIP process is complete, the can 40 and conduits 42 are machined from the now monolithic component 60, which can be finished to its final dimensions.

The advantage of the present invention begins, in general, with the reduction in waste compared with machining the component 60 from a solid block. This presupposes, to some extent, that the metal of the component is a superalloy, or some other exotic material, which tends to suffer two disadvantages. The first is that they are usually expensive materials, and therefore waste is to be minimised, even if it can be recycled. The second is that they are often hard materials that are difficult to machine. Indeed, it is usually for that reason that such metals and alloys are employed for the component in the first place. However, if a component has a complicated shape, that makes machining a very difficult process to complete. In that event, powder metallurgy may be an appropriate method of manufacture. In any event, minimisation of the machining required is always advantageous, even for less expensive or hard materials. Of course, this has to be set against the substantially greater cost of the raw material of the metal in question in powder form, as well as the pre-processing required in the fabrication of the can, the hot isostatic pressing process, and the subsequent post-processing required to remove the can and finish the component.

Figure 6A:
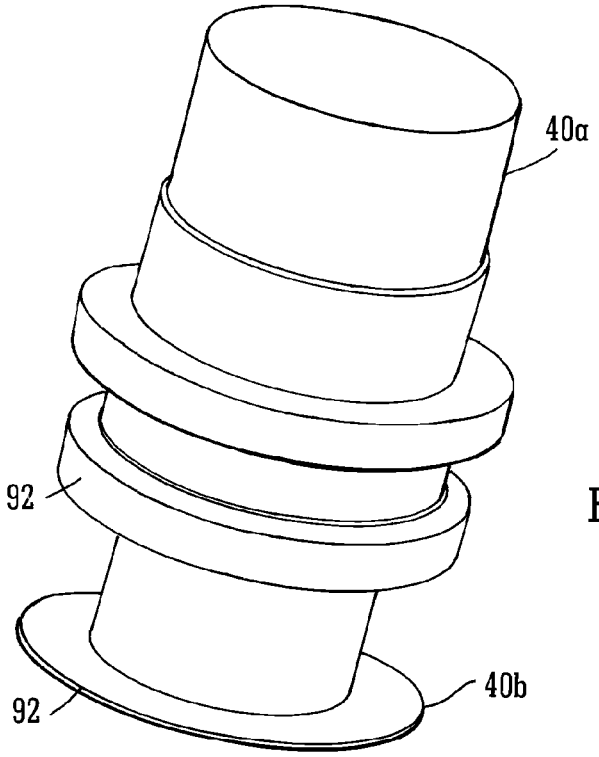
FIGS. 6*a* and *b* are illustrations of different stages in the manufacture of a further modified can.
Figure 6B:
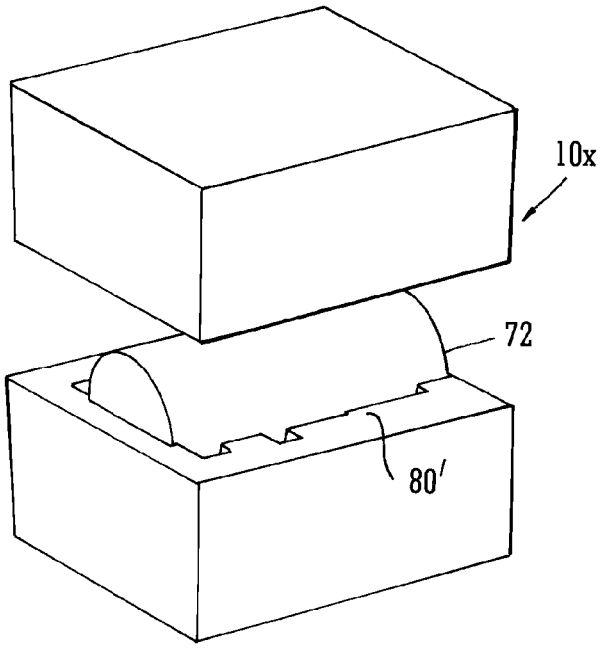
Figure 7:
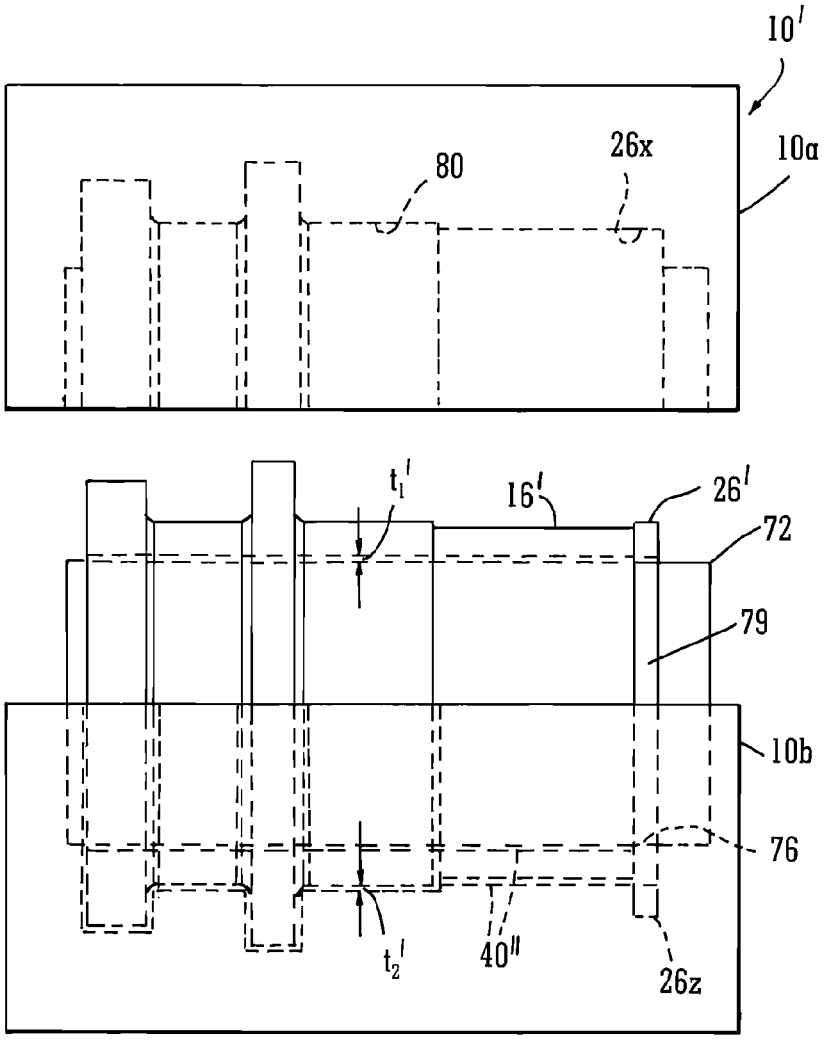
FIG. 7 is a transparent side view of the mould forming the can blank in the arrangements illustrated in FIGS. 5*a* to *e*.

FIGS. 5, 6 and 7 show another embodiment illustrating a method of manufacture of a tubular can. Here, a "hole" 20' comprises an annular end of the can 40' that requires closing with a ring-shaped lid (not shown, which itself would be provided with the conduits 42 (of the FIG. 4 embodiment) for filling the can with powder, evacuating the can of gas, and sealing it closed. The ring would be welded around the inner and outer peripheries of the hole 20' and that end of the component could be elongated, for example, to enable any intrusions from the welds to be machined off.

Figure 5A:
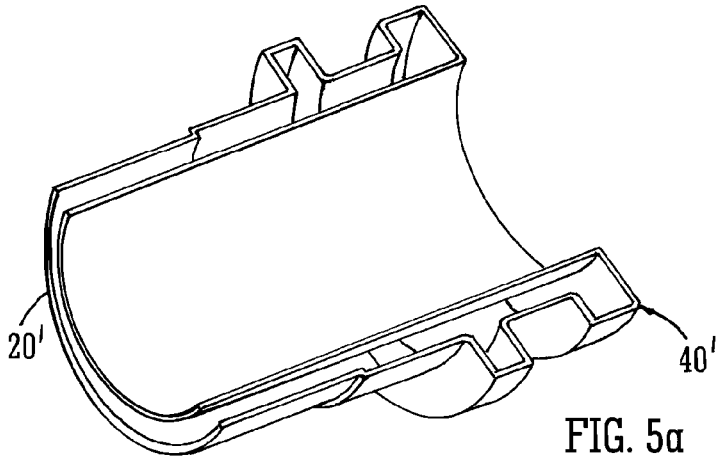
FIGS. 5*a* to *e* are illustrations of different stages in the manufacture of a different embodiment of a can in accordance with the present invention.
Figure 5B:
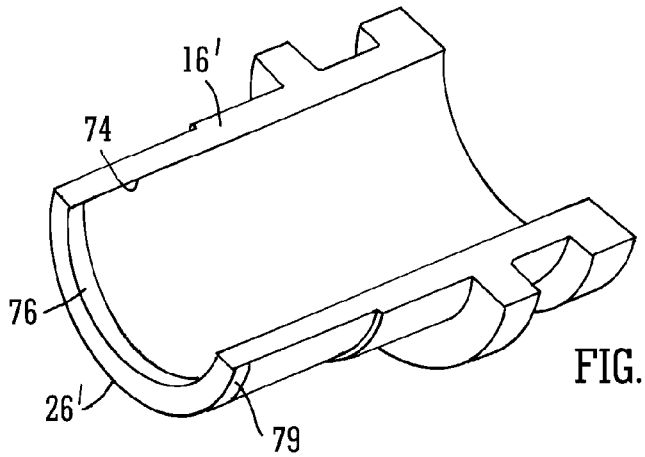
Figure 5C:
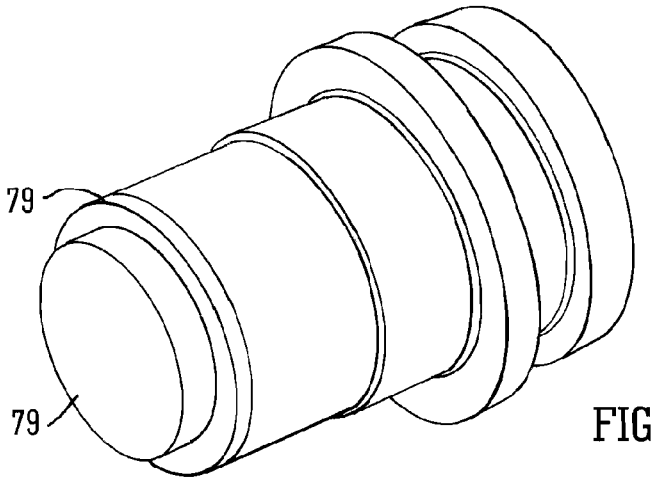
Figure 5D:
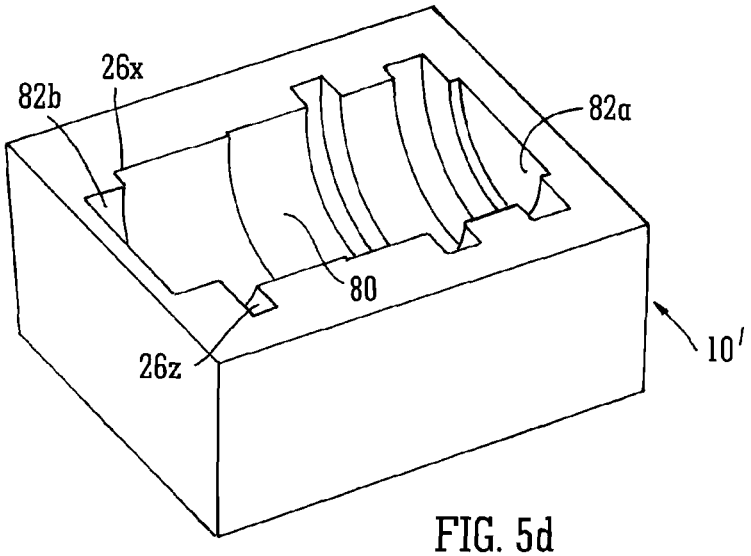
Figure 5E:
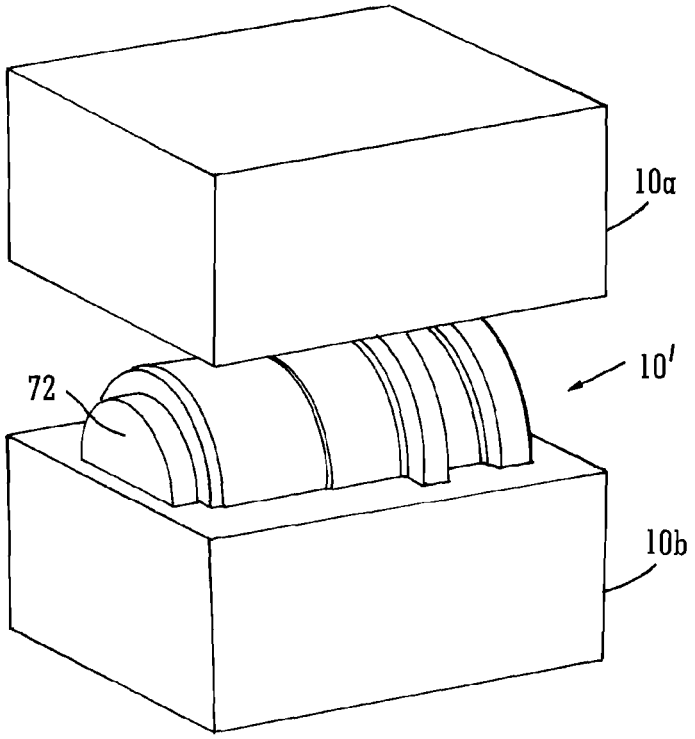

The can 40' is made by the following process. A blank 16' is first moulded of the desired end shape of the component product to be made (including any oversizing to accommodate shrinkage during the HIP process). The blank is moulded from a soluble ceramic material suitable for casting mild steel. However, it can be made from a first wax-type material. The blank includes a ring "stem" 26'. At this point, contrary to what is shown in FIGS. 5*b* and 5*c*, there is no can 40' yet formed around the blank.

Next, a metallic cylindrical core 72 is inserted in the bore 74 of the blank 16', where the core is a close sliding fit in the bore 76 of the ring stem 26' but forms a cylindrical gap of thickness $t_1'$ between the core 72 and bore 74. The ring 76 is rendered long enough that gravity does not cause the blank 16' to drop significantly at its end remote from the ring 26' and thereby affect the dimension $t_1'$ around the circumference of the blank 16'.

A shell mould 10' is prepared. Mostly likely, as shown, this comprises two half moulds 10*a,b* adapted to mate face to face. The moulds are machined from aluminium or like material with an internal profile 80 corresponding with the desired external profile of the can 40'. In addition, however, the shell moulds include two additional surfaces. A first 26*x*, which is an extension of the profile of the can 40', corresponds with the external surface 79 of the ring stem 26'. The second is a recess 82*a,b* at each end of the mould to receive and closely support and surround the ends of the core 72. The surface 26*x* may advantageously be inset, as shown in dotted lines at 26*z*, so that a flange of the ring stem 26' (which flange is not shown in the drawings) engages the inset surface 26*z* and securely locates the blank 16'.

FIG. 7 shows the assembled (but not shut) mould 10' in transparent side section. The thin U-shaped section 40", left unfilled in the mould, is visible around the core 72, between it and the blank 16' (thickness $t_1'$), and within the mould shell 10*b*, between it and the blank 16' (thickness $t_2'$). When the mould is just, hot wax is injected into the space and 40" and allowed to cool. Then the shell mould is opened and the core removed, the result is as shown in FIG. 5*b*.

Depending on what the blank 16' is made from, it is either removed to leave the shell "can" 40', as shown in FIG. 1, or it is retained if it is a ceramic material suitable for casting steel. In the first case, all surfaces of the can 40' are coated with a self-supporting layer of ceramic. In the second case, the outside surfaces of the assembly (as shown in FIG. 5*b*) is coated. In either case, once the ceramic has solidified, the wax constituting the "can" 40' is melted and removed and replaced by casting of mild steel. After cooling and solidification of the steel, the ceramic shell is broken and removed and the remaining process is as described above with reference to FIGS. 1 to 4.

A modification shown in FIGS. 6*a* and *b* makes the "can" blank 40 in two parts, 40*a,b*, each moulded in different moulds 10*x* (FIG. 6*b*, which is incomplete for each component 40*a,b*. For component 40*a*, the shell mould is correctly shown with its internal profile 80 corresponding with the external profile of the element 40*a*. However, the core 72' is inaccurate because it should have an external profile corresponding with the desired internal profile of the element 40*a*. Likewise, in reverse, the core 72' is correctly shown for moulding the internal surface of the element 40*b*, but the profile 80' is incorrect, and should correspond with, the external profile of the element 40*b*. Thus two open and shut moulds 10*x* are required for moulding separately the parts 40*a,b*. However, once separately mould together, they are connected together along mutually facing rims 92 so that the required can blank is formed. That is then used to shape the ceramic mould in which the steel can is constructed.

The specific advantages of the present invention, therefore, are as follows:

The method enables the preparation of a repeatable mould, offering repeatable tolerances, whereby the wastage required, even already minimised by use of the HIP process, can be further reduced, giving known and controlled shrinkage of the powder during the HIP process, so that even nearer net-shape components can be constructed, using less input powder and less post-production machining time.

Using a repeatable mould offers repeatable tolerances avoiding the need to machine from solid material the inner and outer details of the can, which is more expensive than having a 'master' mould followed by steel casting of a can.

Casting a repeatable mould offers the opportunity for more detail of intricate features.

Casting a repeatable mould reduces or eliminates the amount of linear welding required of the can and provides less potential cracking of the can during the HIP process, especially if welds can be avoided that would be in shear during HIP process, and therefore exposed to greater risk of crack development).

The first advantage mentioned above is particularly important where multiple identical components are required, in which event the initial costs of production of the ceramic mould and the can be shared between and sunk within the overall cost of production of the multiple components.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method of forming a component from metal powder, comprising the steps of:

a. providing a ceramic mould using a lost wax process;
b. casting liquid metal in the ceramic mould to form a can;
c. forming one or more holes in the can;
d. filling the can through the hole or holes with the metal powder;
e. settling the metal powder in the can, evacuating the can of gas and sealing the can; and
f. subjecting the can and contained powder to a hot isostatic pressing environment to fuse the metal powder into a solid component.

2. The method of claim 1, wherein conduits are welded onto said can around some or all of the holes.

3. The method of claim 1, wherein the hole or holes in the can are formed during casting of the can by providing a hole-forming pip or pips in the ceramic mould.

4. The method of claim 1, wherein a finishing step, comprising machining the can from the formed component and completing any final dimensional corrections, is implemented after said component is formed by said exposure to hot isostatic pressing.

5. The method of claim 1, wherein the ceramic mould is made by:

a. forming a ceramic blank of the component from a first ceramic material;
b. coating the blank with a sacrificial layer of a thickness equal to the desired thickness of the can to be formed;
c. providing the sacrificial layer with a sacrificial stem;
d. coating the blank and sacrificial layer with a ceramic layer of a second ceramic material, leaving the sacrificial stem protruding through the ceramic layer;
e. curing the ceramic layer; and
f. heating the mould to remove the sacrificial layer and stem.

6. The method of claim 5 wherein the sacrificial layer is wax, a wax-like material or a material, such as polystyrene, that melts or vaporises on heating.

7. The method of claim 5, wherein the step of casting the liquid metal into the ceramic mould simultaneously removes the sacrificial layer and stem.

8. The method of claim 5, wherein the ceramic blank is hollow and is formed by:

a. forming a ceramic cup between a mould and a core;
b. forming a ceramic lid which mates with said cup; and
c. mating said cup with said lid.

9. The method of claim 1, wherein the ceramic mould is made by:

a. forming a blank of the component from a first material, the blank including a stem extending from the shape of the component to be formed;
b. providing a shell mould in at least two parts;
c. mounting the blank in the mould by clamping the stem between the mould parts;
d. moulding a sacrificial layer in the mould in the shape of the can to be formed;

e. coating the sacrificial layer with a ceramic layer of a ceramic material, leaving the stem protruding through the ceramic layer; and f. curing the ceramic layer.

10. The method of claim 9, further comprising the step of:

g. treating the ceramic mould formed by said curing of the ceramic layer to remove the sacrificial layer and stem.

11. The method of claim 9, wherein the blank is formed as a solid ceramic component capable of comprising part of the ceramic mould in which the can is cast.

12. The method of claim 9, in which the shell mould is machined from an aluminium or like material block.

13. The method of claim 9, in which the component to be formed comprises a tubular shape, the step of providing a shell mould in at least two parts being supplemented by providing a mould core and disposing the mould core inside the blank before the core and blank together are mounted in the mould, the core also being clamped between the mould parts.

14. The method of claim 9, wherein the core is aluminium or like material.

15. The method of claim 9, in which the stem comprises a cylindrical surface which, when clamped between the mould parts suspends the blank within the mould parts to define at least a cup shaped space between the blank and the mould, of a shape corresponding with the shape of the can to be formed.

16. The method of claim 15, in which the component to be formed comprises a tubular shape, the step of providing a shell mould in at least two parts being supplemented by providing a mould core and disposing the mould core inside the blank before the core and blank together are mounted in the mould, the core also being clamped between the mould parts, and in which the stem is annular and is a close sliding fit on said mould core, whereby the space defined around the blank between the core and mould parts is essentially two parallel U-shapes in section.

17. The method of claim 1, further comprising providing the can for use in steps c, d, e and f.

18. The method of claim 17, wherein the can has no weld seams between surfaces of the can that contact the powder during said hot isostatic pressing process.

19. The method of claim 17, wherein the can has weld seams only around a single lid of the can, which lid closes a hole left by the moulding process forming the can.

20. The method of claim 1, wherein the hole or holes in the can are formed during casting of the can by providing a hole-forming pip or pips in the ceramic mould and further comprising welding plates onto said can around some or all of the holes.

* * * * *